United States Patent [19]

Simm et al.

[11] 4,319,380

[45] Mar. 16, 1982

[54] TELESCOPABLE GUIDING DEVICE FOR HOUSEHOLD APPARATUS

[75] Inventors: Hans-Peter Simm, Wuppertal; Wieland Gühne, Remscheid-Hasten; Annegret Schlecht, Wuppertal, all of Fed. Rep. of Germany

[73] Assignee: Vorwerk & Co. Interholding GmbH, Wuppertal, Fed. Rep. of Germany

[21] Appl. No.: 151,102

[22] Filed: May 19, 1980

[30] Foreign Application Priority Data

May 29, 1979 [DE] Fed. Rep. of Germany ..... 7915432

[51] Int. Cl.[3] ..... A47L 9/28; A47L 9/32

[52] U.S. Cl. ..... 15/410; 15/144 B; 24/115 G; 24/251; 174/46; 174/69

[58] Field of Search ..... 15/144 B, 410; 175/46, 175/69; 24/115 G, 130, 131, 251, 260

[56] References Cited

U.S. PATENT DOCUMENTS

| | | | |
|---|---|---|---|
| 1,849,663 | 3/1932 | Finnell | 15/410 X |
| 1,918,519 | 7/1933 | Clements | 15/410 X |
| 2,607,863 | 8/1952 | MacFarland | 15/410 X |
| 2,902,592 | 9/1959 | Cole et al. | 174/69 X |

*Primary Examiner*—Chris K. Moore

*Attorney, Agent, or Firm*—Michael J. Striker

[57] ABSTRACT

A guiding device for a household apparatus has a first tubular member fixedly mounted on a housing of the apparatus, a second tubular member which is telescopable relative to the first tubular member and has a handle and a switch, and an electric conductor which extends inside the tubular members and is helical inside the fixedly mounted tubular member and rectilinear in the telescopable tubular member so as to extend from the housing of the apparatus to the switch and to be clamped in the telescopable tubular member in the region of an initial end portion of the latter.

12 Claims, 5 Drawing Figures

TELESCOPABLE GUIDING DEVICE FOR HOUSEHOLD APPARATUS

BACKGROUND OF THE INVENTION

The present invention relates to a telescopable guiding device for a household apparatus, particularly a vacuum cleaner. More particularly, it relates to a guiding device having two telescopable tubular members, wherein one of the guiding members is fixedly arranged on the housing of the household apparatus, whereas the other of the tubular members is telescopable relative to the one tubulaar member and has a handle.

Guiding devices of the above-mentioned general type are known in the art. A known device is mounted on a household apparatus, such as a vacuum cleaner and the like. It is also known to guide the electric connecting conductor from the household apparatus to a wall socket, via an outer clamp provided on the telescopable tubular member. The switch operative for starting a working process is arranged on the household apparatus. The known constructions possess, however, many disadvantages. A considerable disadvantage of the known constructions is that in the conventional telescopable guiding devices the electric conductor extends outside of the same and is held by the outer clamp. When the guiding device becomes shorter, the length of the conductor must also be made shorter by manual pulling of the conductor. When the guiding device becomes longer, the conductor must be made longer also manually, because in general a pulling force is applied to the conductor and its mounting point on the household apparatus.

SUMMARY OF THE INVENTION

Accordingly, it is an object of the present invention to provide a telescopable guiding device for a household apparatus, which avoids the disadvantages of the prior art.

More particularly, it is an object of the present invention to provide a guiding device for a household apparatus, in which the electric conductor and the telescopable guiding device are so arranged that the length of the conductor can always correspond to the length of the guiding device and the household apparatus operates in a simple manner.

In keeping with these objects and with others which will become apparent hereinafter, one feature of the present invention resides, briefly stated, in that an electric conductor extends from a housing of a household apparatus inside a telescopable guiding element to a switch arranged on a handle, wherein the electric conductor is arranged helically in a tubular member which is fixedly connected with the housing of the household apparatus, and then extends rectilinearly through a telescopable tubular member and is clamped in a clamping arrangement provided in an initial portion of the telescopable tubular member.

In accordance with another feature of the present invention, the clamping arrangement is formed as an insert element insertable into the telescopable tubular member and has a body and two opposite elastic tongues provided with outer edges which extend outwardly beyond the periphery of the body when the insert element is located outside of the telescopable tubular member.

In accordance with still another feature of the present invention, when the insert element is inserted in the telescopable tubular member, the outer edges of the tongues abut against the inner surface of the telescopable tubular member and the tongues are displaced inwardly toward the conductor extending through the insert element.

In accordance with further feature of the present invention, the elastic tongues are provided with inner clamping edges arranged at the opposite side relative to the outer edges. The inner and outer edges may be formed as projections extending from the respective sides of the tongues.

Finally, in accordance with still a further feature of the present invention, guiding wall members may be provided in the insert element, the guiding wall members extending at opposite sides of the elastic tongues from one elastic tongue to the other elastic tongue. The electric conductor conduit is received between and clamped by the inner clamping edges of the elastic tongues.

When the telescopable guiding device is designed in accordance with the present invention, it has an advantage residing in the fact that the electric conductor is arranged inside the telescopable guiding element, and the switch for actuation of the household apparatus may be mounted on the handle of the guiding element. The operation of the household apparatus and the guiding device is considerably simpler for the user.

The novel features of the present invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
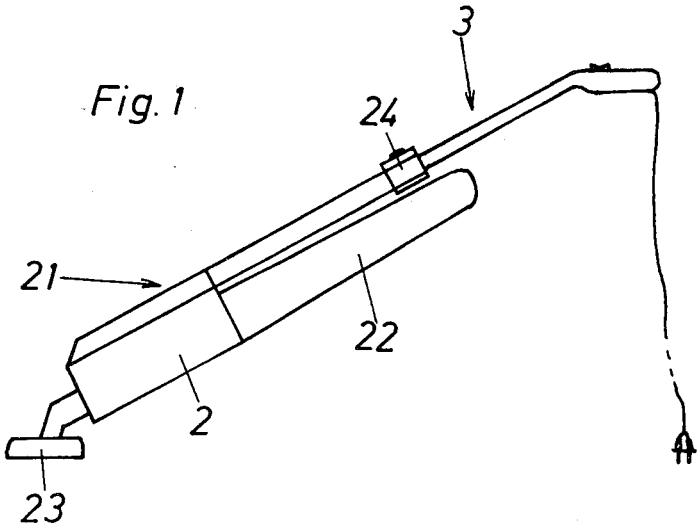
FIG. 1 is a view showing a vacuum cleaner with a telescopable guiding device, a switch on a handle, and an electric conductor.

FIG. 1 shows a vacuum cleaner 21 which is composed of a vacuum cleaner housing 2, a telescopable guiding element 3, a suction sack 22 and a suction nozzle 23.

The telescopable guiding element 3 is composed of a tubular member 6 which is fixedly mounted on the housing 2, and a telescopable tubular member 7. An arresting arrangement is provided between two tubular members 6 and 7. The telescopable tubular member 7 carries a handle provided with a switch 4 for starting up the operation of the vacuum cleaner 21.

An electric conductor 1 extends from the handle 5 to a not-shown wall socket. The electric conductor 1 extends through the telescopable tubular member 7 and through the fixedly mounted tubular member 6 to the housing 2 of the vacuum cleaner. The electric conductor 1 is thereby guided in a predetermined manner, as can be seen from FIG. 5, and held in a clamping arrangement 9 as can be seen form FIG. 2.

Figure 2:
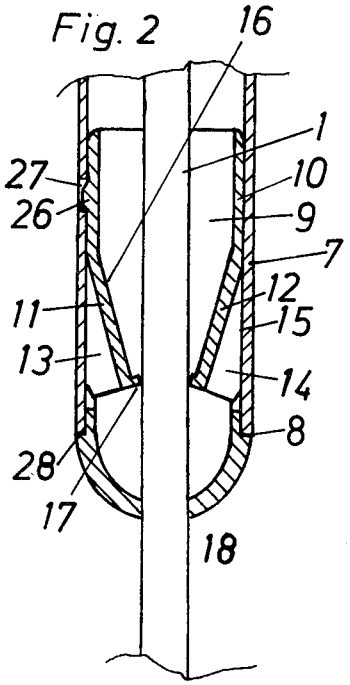
FIG. 2 is a view showing a longitudinal section of a telescopable tubular member of the guiding device, with an electric conductor and a clamping element.
Figure 3:
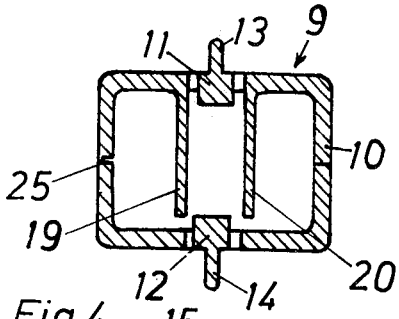
FIG. 3 is a view showing a section of the clamping element of FIG. 2, turned by 90°.
Figure 4:
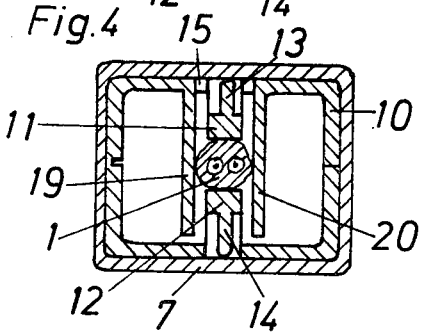
FIG. 4 is a view showing a section of the clamping element of FIG. 2 turned by 90°, the clamping element being inserted in the telescopable tubular member.

FIG. 2 shows a portion of a longitudinal section of the telescopable tubular member 7. An initial part 8 of the telescopable member 7 is provided with a clamping arrangement 9. The clamping arrangement 9 holds in a special manner the electric conduit 1. This is illustrated in FIGS. 2, 3 and 4.

The clamping arrangement 9 includes an insert element 10. The insert element 10 is foldable inasmuch as it is provided with a so-called film hinge 25. The insert element 10 has two elastic tongues 11 and 12 having outer edges or projections 13 and 14, respectively. The elastic tongues 11 and 12 also have inner clamping edges or projections 17 and 18. The clamping projections 17 and 18 are arranged at the opposite side 16 of the clamping element 10, relative to the outer projections 13 and 14.

The insert element 10 further has two guiding wall members 19 and 20. The guiding wall members 19 and 20 are located at opposite sides of the tongues 11 and 12 and extend from one tongue 11 to the other tongue 12. As can be seen from FIG. 3, the wall members 19 and 20 extend from one side wall of the insert element 10 toward the other side wall and terminate shortly before the latter.

The operation of the guiding device is performed in the following manner. When the insert element 10 together with the electric conductor 11 is inserted into the telescopable tubular member 7 (see FIGS. 2 and 4), the out projections 13 and 14 of the tongues 11 and 12 abut against an inner surface 15 of the telescopable tubular member 7. The elastic tongues 11 and 12 are thereby forceably displaced inwardly of the insert element. The clamping projections 17 and 18 firmly clamp the electric conductor 1 between the guiding wall members 19 and 20. When the insert element 10 is sufficiently inserted, it is arrested by a projection 26 in a hole 27 provided in the telescopable tubular member 7. The tubular member 7 supports with the flange 28 and is thereby arrested.

Figure 5:
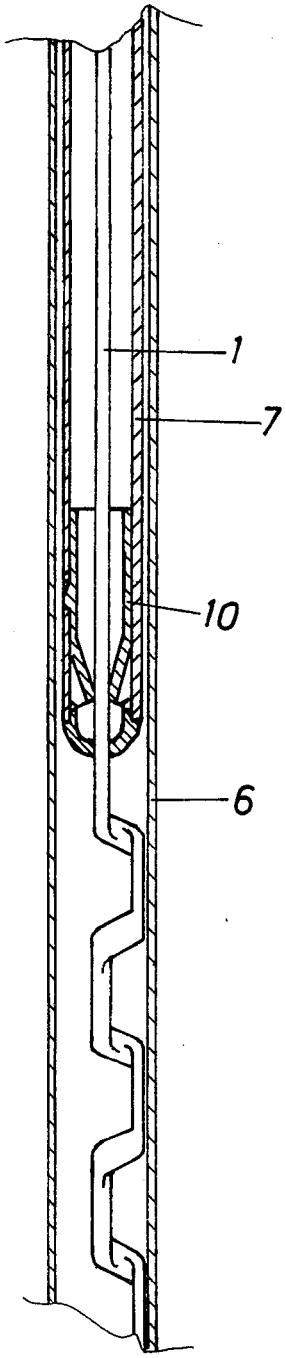
FIG. 5 is a view showing a longitudinal section of a fixedly connected tubular member in which the telescopable tubular member with the electric conductor extend.

FIG. 5 shows a longer portion of a longitudinal section of both tubular members 6 and 7. The fixedly mounted tubular member 6 accommodates a portion of the electrical conductor 1. This portion which extends through the fixedly mounted tubular member 6 is helical so that its length can be increased. The telescopical tubular member 7 with the insert element 10 are arranged within the fixedly mounted tubular member 6. The insert element 10 firmly clamps the electric conductor 1. The electric conductor 1 extends further from the insert element 10 rectilinearly to the switch 4 inside the telescopable tubular member 7. It should be mentioned that the drawings are provided only for illustration purposes and not drawn in actual scale. The gaps and passages in the drawing are shown considerably greater than they actually must be. It will be understood that each of the elements described above, or two or more together, may also find a useful application in other types of constructions differing from the types described above.

While the invention has been illustrated and described as embodied in a guiding device for a household apparatus, such as a vacuum cleaner, it is not intended to be limited to the details shown, since various modifications and structural changes may be made without departing in any way from the spirit of the present invention.

Without further analysis, the foreoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A guiding device for a household apparatus having a housing, particularly for a vacuum cleaner, the guiding device comprising a telescopable guiding element including a first tubular member arranged to be fixedly connected with a housing of a household apparatus, and a second tubular member which is telescopable relative to said first tubular member and has a handle with a switch, said second tubular member having a proximal end portion and a distal end portion relative to said first tubular member; an electric conductor arranged to extend inside said telescopable guiding element from the housing of the household apparatus to said switch, said electric conductor extending first helically through said first fixedly connected tubular member and then rectilinearly through said telescopable tubular member and is clamped in the latter in the region of said proximal end portion; and means for clamping said electric conductor in said second telescopable tubular member in the region of said proximal end portion, said clamping means including an insert element insertable into said second telescopable tubular member, said inert element having a hollow body and two oppositely located elastic tongues each having an outer edge which extends outwardly beyond the periphery of said body prior to the insertion of said insert element into said second telescopable tubular member, said electric conductor extending inwardly of said insert element.

2. A guiding device as defined in claim 1, wherein said handle with said switch is arranged in the region of said distal end portion of said second telescopable tubular member.

3. A guiding device as defined in claim 1, wherein each of said tongues has an outer projection forming a respective one of said outer edges.

4. A guiding device as defined in claim 1, wherein said body has an outer surface, said projections of said tongues being inclined to said outer surface of said body.

5. A guiding device as defined in claim 1, wherein said second telescopable member has an inner surface, said projections of said tongues being arranged so that when said insert element is inserted into said second telescopable tubular member, said projections abut against said inner surface of the latter and said tongues with said edges are displaced inwardly of said body toward said electric conductor.

6. A guiding device as defined in claim 1, wherein each of said tongues has an inner surface and an outer surface, said outer edges being arranged on said outer surface of the respective tongues, each of said tongues having an inner edge arranged on said inner surface of the same.

7. A guiding device as defined in claim 6, wherein each of said tongues has an inner projection forming a respective one of said inner edges.

8. A guiding device as defined in claim 6, wherein each of said outer edges is arranged on a respective one of said tongues at a predetermined location, each of said inner edges being arranged at a location corresponding to the location of a respective one of said outer edges.

9. A guiding device as defined in claim 6, wherein said inner edges of said tongues are arranged so that said electric conductor is received between and clamped by said inner edges when said insert element is inserted in said second telescopable tubular member.

10. A guiding device as defined in claim 1, wherein said elastic tongues are spaced from one another in a first direction, said insert element further having two guiding wall members located at opposite sides of said tongues as considered in a second direction transverse to said first direction, said guiding wall members extending from one of said tongues to the other of said tongues.

11. A guiding device as defined in claim 10, wherein said body of said insert element has two opposite wall portions which are spaced from one another in said first direction and on which said tongues are arranged, said guiding wall members extending from one of said wall portions toward the other of said wall portion and terminate shortly before the latter.

12. A guiding device as defined in claim 1, wherein said insert element is elongated and foldable and unfoldable in direction transverse to the direction of elongation.

* * * * *